United States Patent [19]

Rossetti

[11] 4,090,717

[45] May 23, 1978

[54] EDUCATIONAL GAME

[76] Inventor: Susan Rossetti, 801½ E. 2nd St., Cle Elum, Wash. 98922

[21] Appl. No.: 739,460

[22] Filed: Nov. 8, 1976

[51] Int. Cl.[2] ..... A63F 3/00

[52] U.S. Cl. ..... 273/249; 273/302; 35/9 R

[58] Field of Search ..... 273/134 AB, 134 AT, 273/134 C, 134 D, 134 BD, 134 AA; 35/31 G, 35 J, 9 R

[56] References Cited

U.S. PATENT DOCUMENTS

| | | | |
|---|---|---|---|
| 1,635,734 | 7/1927 | Ziegler | 273/134 AC |
| 1,653,464 | 12/1927 | Lomas | 273/134 AC |
| 1,843,183 | 2/1932 | Thompson | 35/31 G |
| 2,717,156 | 9/1955 | Nelson | 273/134 C |
| 3,154,863 | 11/1964 | Prelle | 35/31 G |
| 3,242,596 | 3/1966 | Smith | 35/9 R |
| 3,284,925 | 11/1966 | Leventhal et al. | 35/9 R |
| 3,656,751 | 4/1972 | Glass et al. | 273/134 C |
| 3,899,177 | 8/1975 | Sells | 273/134 AD |
| 3,939,578 | 2/1976 | Coffey | 273/134 C |

*Primary Examiner*—Robert W. Michell
*Assistant Examiner*—Arthur S. Rose

[57] ABSTRACT

A game using a standard reference work, such as a set of encyclopedias, as one of the game components. A game board displays a path of travel along which the players each move a marker, with progress along the path being determined partly by the player's success in correctly answering questions within the prescribed time, and partly by the roll of a single die. There is a set of question cards, each of which asks for information obtainable from the encyclopedia; a timer to limit the period of each person's turn; and a set of answer cards to determine the correctness of the information obtained.

4 Claims, 8 Drawing Figures

Fig. 1.
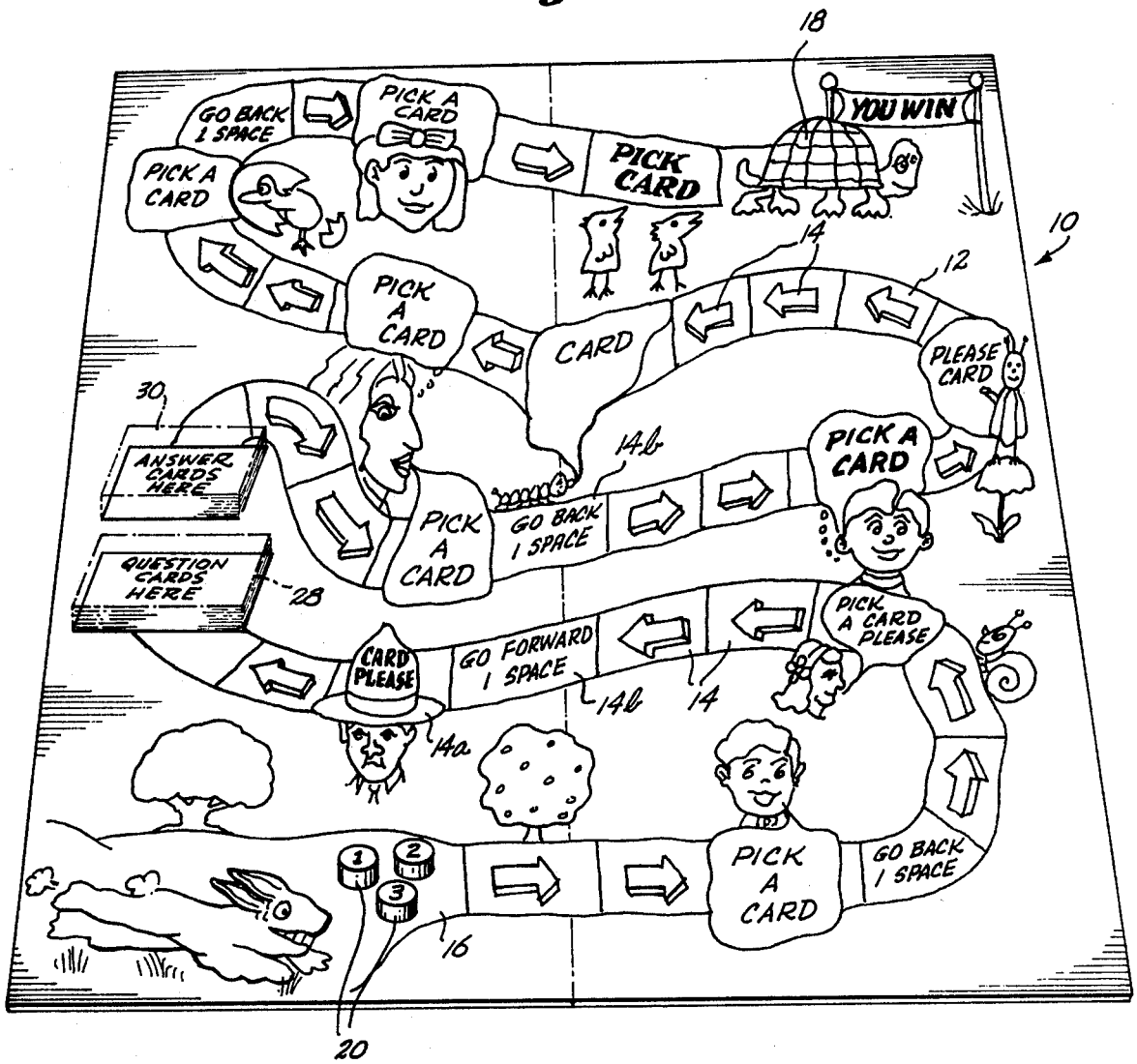
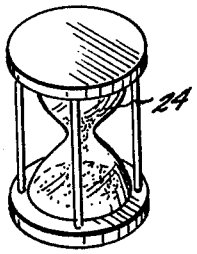
Fig. 2.
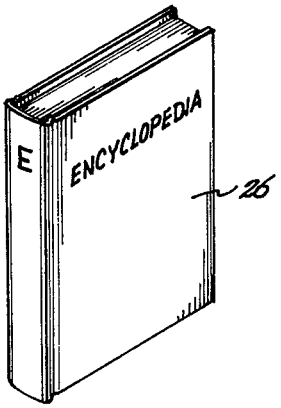
Fig. 4.
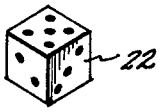
Fig. 3.

Fig. 5.

WHAT IS EGLANTINE? 28

WHAT COLOR IS AN ERMINE'S FUR IN WINTER? 28

WHAT IS THE NORMAL RANGE OF HUMAN HEARING? 28

Fig. 6.

A TYPE OF ROSE 30

WHITE 30

AT LEAST NINE OCTAVES 30

Fig. 7.

15 28

15 30

Fig. 8.

EGLANTINE
A TYPE OF ROSE COMMONLY FOUND IN . . . . . .

ERMINE
A MAMMAL . . . . .
. . . . . .
IN WINTER MONTHS THE ERMINES FUR TURNS WHITE.

EAR
AN ORGAN OF THE BODY . . . . . .
. . . . . .

THE NORMAL RANGE OF HEARING FOR A HUMAN IS NINE OCTAVES.

EDUCATIONAL GAME

BACKGROUND OF THE INVENTION

1. Field of the Invention

The present invention relates to an educational game in which the success of each participant is determined at least in part by his ability to derive correct information from a reference work such as a standard encyclopedia.

2. Description of the Prior Art

There are in the prior art a number of games of the question and answer type where the success of the participants is determined by his or her ability to correctly answer questions presented in the course of the game. In some instances, the format of these games has resembled a radio or television quiz program, with the questions being of such a type which could be expected to be within the knowledge of a reasonably well informed person. In such games, the answers to such questions are provided in a conveniently available form so that the correctness of the answer can be readily ascertained during the progress of the game.

Certain games of this type have appeared in the patent literature. For example, U.S. Pat. No. 1,635,734, Ziegler, shows a game where there is a game board having a path of travel along which are written various questions, with answers being provided along the side of the board. For the player to successfully complete travel over this path to an end destination, which is a school house, he must successfully select the right answer from the margin of the board. As an alternate, the player can select geographical locations from an associated map, and this can be used in conjunction with cards having the questions on one side and the answers on the other.

U.S. Pat. No. 2,717,156, Nelson shows a question and answer game where the questions are printed on one side and the answers on the other. These question and answer cards are arranged in subject catagories, and a spinner is used to determine from which catagory the player is to have his question selected. The player reads the question on one side, gives his answer, and if this corresponds to the correct answer on the opposite side of the card, that player is able to progress along the path of travel of a game board.

Other examples of the prior art are shown in the following patents: U.S. Pat. No. 1,148,737, Atkins; U.S. Pat. No. 2,693,961, Ripley; and U.S. Pat. No. 3,734,508, Snyder. While these patents do not relate to games of a question and answer type, they are representative of various game board configurations and game components used in conjunction therewith.

It is an object of the present invention to provide an educational game in which a standard reference work, such as an encyclopedia, is utilized as one of the game components, with the game being arranged so that the participants develop skills in informational research by use of such reference work.

SUMMARY OF THE INVENTION

There is a game board having a representation of a course of progress, such as a path leading from a beginning point to an end point and divided into increments of travel, such as squares, along which progress indicators, such as markers, can be moved to indicate the progress of a player. In the preferred form, some of the squares merely indicate progress along the course, while certain of the squares indicate that the participant should draw a question card.

As a second game component, there is a standard reference work, such as an encyclopedia, containing information organized in a retrievable manner. In the desired form, this information is organized under key subject headings arranged alphabetically in the reference work, with at least part of the information under these headings being ordinarily retrievable within a range of a predetermined search time period.

There is a set of question and answer indicating means relating to retrievable information in the reference work, arranged in a manner to display the questions in a format separate from the answers. This can conveniently be accomplished by arranging the questions in one or more sets of question cards, and placing the answers on a separate set or sets of answer cards which are made to correspond in some easily identifiable way (e.g. by numerical designations or the like) to the appropriate question cards.

A timing device is provided to indicate a time period within the above-mentioned time range during which information, such as that asked for in the question cards, can be reasonably retrieved from the reference work. Finally, there is a single die, displaying numerals one through six, which can be thrown by the players to determine the order of turn, and progress along the course of the game board.

In playing the game, each participant in turn progresses along the course of the game board by traveling a number of squares along the course in accordance with a throw of the die. When the participant encounters a "question square", that person draws a qestion card and reads the qestion thereon, and at the same time the timing device is started to measure the period during which the player must answer the question successfully by finding the correct information in the reference work. If the person successfully finds the answer in the reference work within the prescribed time, his or her progress along the course is not impaired. However, if the person is not able to find the correct information, that person must move the marker back to the previously occupied square.

Where an encyclopedia is used as the reference work, desirably a plurality of sets of questions and answer cards are used, with each set asking information which leads into the key subject headings alphabetically arranged to be contained in a particular volume of the encyclopedia.

BRIEF DESCRIPTION OF THE DRAWING

FIG. 1 is a perspective view of a game board of the present invention;

FIG. 2 shows a timer to determine the length of each player's turn;

FIG. 3 shows a single die by which a player's progress along the game board is determined;

FIG. 4 shows a single volume of a reference work (i.e. an encyclopedia) used as a game component;

FIG. 5 shows several of a set of question cards displaying typical questions related to the reference work of FIG. 4;

FIG. 6 shows several answer cards corresponding to the question cards of FIG. 5;

FIG. 7 shows the back side of a pair of question and answer cards, and

FIG. 8 shows typical excerpts from the reference work of FIG. 4 containing the information shown on the answer cards of FIG. 6.

DESCRIPTION OF THE PREFERRED EMBODIMENT

In FIG. 1, there is shown a game board 10 displaying on its playing surface a circuitous course of travel 12 divided along its length into squares or spaces 14. The course 12 has a beginning point 16 and a destination point 18. At the location of the beginning point 16, there are shown a plurality of markers 20, each of which is associated with a respective player along the course 12, with the winning player being the one who is able to move his marker 20 in accordance with the game rules along the course 12 to the destination point 18. Most of the squares 14 are provided with arrows which merely indicate direction of travel along the course 12. At relatively frequent locations along the entire length of the course 12, there are certain squares 14*a* which indicate that a question card should be drawn by a player whose marker 20 lands on that square 14*a*. Other squares 14*b* indicate that a marker landing thereon should be moved either forward or backwards, generally such movement being onto a square where a question card must be picked.

The other components of the game are shown in FIGS. 2 through 6. In FIG. 3, there is shown a die 22 which functions in a conventional manner to be thrown to provide a chance numerical value, first to determine the order of play, and then to determine the number of squares each player is to move on that player's turn. In FIG. 2 there is shown a timer in the simple form of a conventional hourglass 24.

In the particular embodiment of the present invention shown herein, the reference work which is used as a game component is a conventional encyclopedia set. One volume of such a set is indicated at 26 in FIG. 4, and the particular volume 26 selected for purposes of illustration is desginated "E", this designation indicating that all the information in this encyclopedia is under alphabetically arranged key word subject headings, all of which being with the letter "E".

In FIG. 5, there are shown several selected samples of a set of question cards 28, each of which has a single question thereon. An examination of the questions on these several cards 28 will indicate that each question asks for information which could reasonably be classified under a subject heading beginning with the letter "E", so as to lead the person into the appropriate place in the encyclopedia volume "E" shown in FIG. 4.

In FIG. 6, there are shown several of a set of answer cards 30 corresponding to the question cards shown in FIG. 5. So that the answer cards 30 can be matched with the question cards 28, each of the question cards 28 is identified on its back side by a number, with the related answer card 30 bearing the same number on its back side, as shown in FIG. 7. FIG. 8 illustrates at 32 several excerpts from the encyclopedia volume 26, which excerpts provide the information asked for in the question card 28 and given in the answer cards 30.

The over all purpose of the game is to stimulate the participants into the effective use of the reference work, such as the encyclopedia volume 26. This is done by requiring the game participants at frequent intervals to encounter in game play a question whose answer can be found under an appropriate subject heading in the associated reference volume 26. The participant is required to do this within a reasonable time period of a predetermined length, and if the player does so, he is able to make satisfactory progress along the course of travel 12 on the game board 10. Whenever the participant fails to obtain the proper information from the reference volume 26, that player is penalized by forfeiting the progress he would have made on that particular turn.

To describe the method of playing this game more specifically, each player rolls the single die 22, with the high roller starting first, second high roller starting second, etc. The players each select a marker 20 and place this marker 20 at the starting point 16. Each player takes a turn in sequence by rolling the die 22 to determine the number of spaces the player moves his marker along the course of travel 12. Whenever the marker lands on one of the question squares 14*a* (either directly or by being directed there from one of the squares 14*b*), that player is required to draw a question card 28. These cards 28 are arranged face down in a stack at a convenient location on the board 10. As the person reads the question on the card 28, a second player starts the hourglass timer 24 simply by turning it over. The first player that has drawn the question card 28 attempts to find the correct answer to that question by finding the appropriate information in the reference volume 26. While the player is searching the volume 26 for this information, the second player finds the answer card 30 corresponding to the particular question card 28 that is drawn, by matching the numerical designations on the back side of the cards 28 and 30.

If the first player finds the correct answer within the allotted time, as indicated by the timer 24, the player is permitted to leave his marker 20 on the square 14*a*. If the first player is not successful in finding the correct answer, he must move his marker back to the square which he previously occupied. The players continue taking their turns as described above in the same sequence, with one of the players finally winning the game by successfully moving his marker 20 to the final destination point 18.

An examination of the questions on the cards 28 of FIG. 5 illustrates the nature of research skills which the participant must exercise. With regard to the first question, "What is eglantine?", this requires simply the task of looking for the proper alphabetical heading, and the answer is readily ascertainable from the information immediately below the subject heading, as can readily be observed from the listing on FIG. 8.

With regard to the second question, "What color is an ermine's fur in winter?", not only is the participant required to find the proper subject heading, namely "ermine", but he is required to peruse the information under that subject heading. Thus, as can be seen in FIG. 8, the player finds the information by reading through the text under that heading, "ermine".

In other instances, the player will be required to exercise judgment in arriving at the appropriate subject heading. For example, in the question printed on the third card of FIG. 5, namely "What is the normal range of human hearing?", the player must first think of an appropriate subject heading which begins with an "E" and is associated with hearing. In this case the information would be under the heading "ear", and as can be seen in FIG. 8, the appropriate information is contained in the text under that heading.

From an examination of the types of questions which can be propounded, it can readily be recognized that there is some variation in the ease with which the information of these various questions can be obtained. However, the questions should be selected so that the information would normally be retrievable within a reasonable range of time. Then the timer 24 or the setting of the timing device should be selected so that the player has some reasonable expectation of obtaining the information for the answer within the allotted time period.

Thus, it can be appreciated that in the playing of this game, there is an element of chance, since the progress of each player is at least partly determined by the throw of the die. On the other hand, there is certainly the element of skill in effective informational retrieval from a reference work. The combination of these add an element of excitement and provide a certain level of intensity in the play which motivates the participants to exercise their information research skills at a relatively high level.

What is claimed is:

1. A game particularly adapted to stimulate participants to improve research skills in using an encyclopedic reference work comprising a plurality of volumes in which information is arranged in said volumes in alphabetically grouped categories, each volume containing alphabetically grouped categories different from that of the other volumes, said game comprising:

a. a game board having a representation of a course, leading from a beginning point to an end point, and divided into increments of travel along which markers can be moved to record progress of a player by moving a related marker along the course, b. a plurality of separated sets of question and answer indicating means, each set corresponding to a respective volume, and each set having indicia corresponding to indicia on its respective volume, with questions of that set asking for information contained under a category alphabetically contained in its respective volume and normally retrievable from that volume within a pre-determined time range, and answers of that set providing said information, said indicating means arranged to display said questions in a format separate from the answers, c. a timing device to indicate a time period of search within said time range, whereby a game participant can maintain progress along the course of the board by the steps of selection of a question, looking into the reference work for a correct answer, utilizing the timing device to indicate the time period of search within which the answer is to be found, and comparing the participant's answer with the correct answer obtained from the indicating means to ascertain the correctness of the participant's answer and thus determine that participant's progress over the course of the board.

2. The game as recited in claim 1, wherein said board has its course separated into squares as increments of travel, some of which have markings indicating that such square requires the participants to draw a question card, said game further including chance means, such as a die, to determine on a numerical chance basis progress of a game participant along the course.

3. A game particularly adapted to stimulate participants to improve information research skills, said game comprising:

a. a game board having a representation of a course, leading from a beginning point to an end point, and divided into increments of travel along which markers can be moved to record progress of a player by moving a related marker along the course, b. an encyclopedic reference work comprising a plurality of volumes in which information is arranged in said volumes in alphabetically grouped categories, each volume containing alphabetically grouped categories different from that of the other volumes, c. a plurality of separated sets of question and answer indicating means, each set corresponding to a respective volume, and each set having indicia corresponding to indicia on its respective volume, with questions of that set asking for information contained under a category alphabetically contained in its respective volume and normally retrievable from that volume within a pre-determined time range, and answers of that set providing said information, said indicating means arranged to display said questions in a format separate from the answers, d. a timing device to indicate a time period of search within said time range, whereby a game participant can maintain progress along the course of the board by the steps of selection of a question, looking into the reference work for a correct answer, utilizing the timing device to indicate the time period of search within which the answer is to be found, and comparing the participant's answer with the correct answer obtained from the indicating means to ascertain the correctness of the participant's answer and thus determine that participant's progress over the course of the board.

4. The game as recited in claim 3, wherein said board has its course separated into squares as increments of travel, some of which have markings indicating that such square requires the participants to draw a question card, said game further including chance means, such as a die, to determine on a numerical chance basis progress of a game participant along the course.

* * * * *